United States Patent [19]

Cagnon et al.

[11] Patent Number: 4,875,850

[45] Date of Patent: Oct. 24, 1989

[54] GAS BURNER OF THE BLOWN AIR AND PREMIXTURE TYPE

[75] Inventors: François Cagnon, Paris; Denis Di Paola, Argenteuil; Georges Austruy, Villetaneuse; André Vinchon, Paris, all of France

[73] Assignee: Gaz de France, Paris, France

[21] Appl. No.: 115,728

[22] Filed: Nov. 2, 1987

[30] Foreign Application Priority Data

Nov. 7, 1986 [FR] France ..... 86 15556

[51] Int. Cl.[4] ..... F23C 5/08

[52] U.S. Cl. ..... 431/8; 431/7; 431/10; 431/278; 431/328; 431/326; 431/354

[58] Field of Search ..... 431/18, 10, 12, 7, 170, 431/175, 278, 283, 285, 326, 329, 328, 347, 349, 354; 126/360 R, 360 H

[56] References Cited

U.S. PATENT DOCUMENTS

| | | | |
|---|---|---|---|
| 3,192,920 | 7/1965 | See et al. | 126/360 A |
| 3,228,451 | 1/1966 | Fraser et al. | 431/10 |
| 3,730,668 | 5/1973 | Iida et al. | 431/10 |
| 3,770,369 | 11/1973 | Mikami et al. | 431/10 X |
| 3,890,084 | 6/1975 | Voorheis et al. | 431/10 |
| 3,957,421 | 5/1976 | Wikman . | |
| 4,224,019 | 9/1980 | Dilmore . | |
| 4,236,464 | 12/1980 | Anderson et al. | 431/10 X |
| 4,289,474 | 9/1981 | Honda et al. | 431/10 |
| 4,499,890 | 2/1985 | Meulenbrug | 431/328 X |
| 4,752,213 | 6/1988 | Grochowski et al. | 431/328 |

FOREIGN PATENT DOCUMENTS

| | | | |
|---|---|---|---|
| 1008855 | 5/1957 | Fed. Rep. of Germany | 431/175 |
| 3230853 | 2/1984 | Fed. Rep. of Germany . | |
| 1057371 | 3/1954 | France . | |
| 2510731 | 2/1983 | France . | |
| 0091108 | 7/1981 | Japan | 431/10 |

OTHER PUBLICATIONS

Revue Generale de Thermique, vol. 22, No. 253, Jan. 1983, pp. 27–45, Paris, France, M. Fardeau, "Nouveaux echangeurs alimentes au gaz naturel pour le chauffage des bains industriels".

P. Hostalier, "De la Combustion Submergee aux Generateurs a Condensation", Gaz D'Aujourd'Hui, vol. 92, No. 11, Nov. 1968.

*Primary Examiner*—Carl D. Price

*Attorney, Agent, or Firm*—Pollock, VandeSande & Priddy

[57] ABSTRACT

Gas burner of relatively low power of the blown air and premixture type comprising separate intakes for air and for combustible gas passing into a premixing chamber discharging into a combustion chamber at the level of which the premixture is ignited by means of a lighting electrode, the air intake and combustible gas intake each comprising at least one flow regulating valve. The burner is characterized in that a device having a calibrated orifice of the injector type is provided on the combustible gas intake while a passage of relatively small cross-section, of the diaphragm type, is provided on the air intake. The invention is particularly applicable to installations comprising this burner to serve as a pilot lighting burner.

1 Claim, 2 Drawing Sheets

GAS BURNER OF THE BLOWN AIR AND PREMIXTURE TYPE

BACKGROUND OF THE INVENTION

The present invention relates to a gas burner of relatively low output, of the forced air and premixing type, comprising separate inlets for air introducing and combustible gas into a premixing chamber for discharge into a combustion chamber in which the premixture is ignited by means of a lighting electrode, the air and combustible gas inlets each comprising at least one flow control valve on the basis of all or nothing with the gas flow and progressive control on the air intake.

With a burner of this type, problems regulating the flow of air and combustible gas frequently arise as a result of fluctuations in pressure or losses of head due, for instance, to a partial obstruction or blockage of a filter mounted on the fan which supplies the burner with air. The feeding of incorrect quantities in the air:-combustible gas ratio produces flame instabilities which seriously impair proper operation of the burner.

SUMMARY OF THE INVENTION

One of the objects of the present invention is to resolve these problems in such a way as to provide a burner of the type described in which the rates of flow of air and combustible gas can be appropriately controlled according to the desired operating conditions, thus making it possible to ensure satisfactory flame stability over the whole range of air and gas supply to the burner, without the risk of blowout or flashback.

This is why, to be more precise, the invention particularly envisages a burner comprising:

a device having a calibrated orifice, of the injector or equivalent type, provided on the combustible gas inlet, and a passage of relatively small cross-section, of the diaphragm type, provided on the air intake in such a way as to create an air supply overpressure in the premixing chamber.

According to an additional feature of the invention, communication between the premixing chamber and the combustion chamber is restricted by a flame stabilizing grille through which is fitted the said lighting electrode, the head of which is connected to an electric power source.

Thus it is possible to finely regulate the quantitative feed of air and combustible gas, and thus assure stable attachment of the flame on the grille.

The burner according to the invention offers other advantages which will in particular become apparent if, in accordance with a particular application envisaged for the invention, it is used as a pilot burner for lighting a burner which is submersible in a liquid to be heated by a more highly powered installation.

The known pilot burners are currently supplied with air and combustible gas through two separate pipes, lighting of the pilot then generally being effected by a simple electrode disposed on the peripheral wall of the combustion chamber.

Although for some uses they offer an acceptable flame stability, such pilot burners operate only imperfectly in a pressurized enclosure, such as a combustion chamber in a submerged tube heating installation, where the pressure is above atmospheric pressure.

In particular, they are particularly sensitive to an improper adjustment of the rate of feed of air and combustible gas to the burner. If there is a fluctuation in the rate of flow of air, followed for instance by a fluctuation in head loss in the pipe, the lighting conditions are rapidly impaired. A suitable adjustment in the rate of flow of combustible gas, although less usual, produces the same effects.

Furthermore, as no overpressure in the combustible gas and air supply is created in the premixing chamber of known pilot burners, the depth of immersion of the main burner in the liquid to be heated is limited.

Another limitation on the depth of immersion results from the habitual disposition of the lighting electrode over the length of the combustion chamber.

The burner according to the invention, used in this case as a pilot burner, effectively makes it possible to resolve these problems.

Finally, the invention relates to a method of lighting a pilot burner of the type which has just been described.

The invention, its characteristic features and advantages, will become more clearly apparent from the ensuing description.

DETAILED DESCRIPTION OF THE INVENTION

Figure 1:
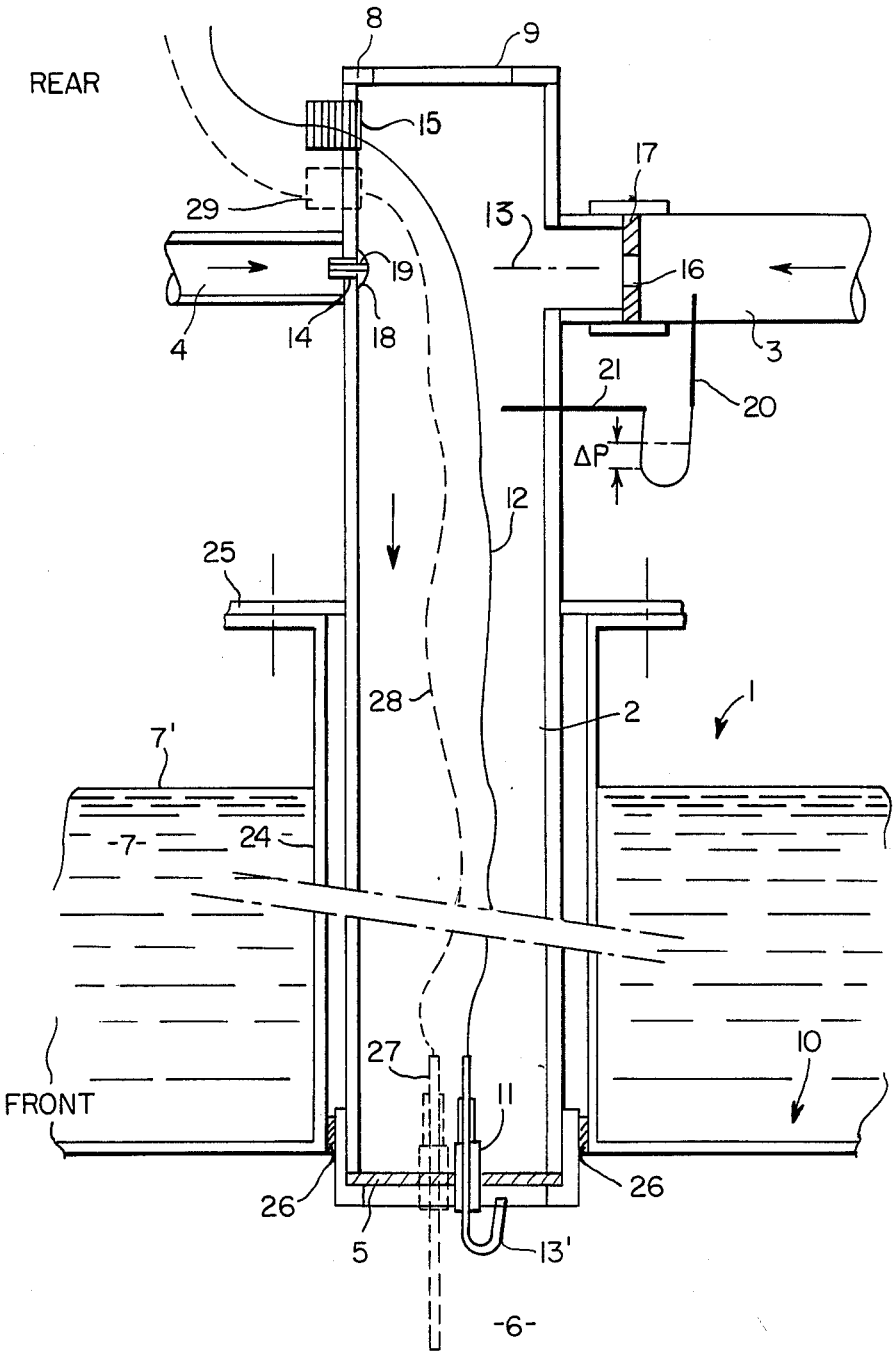
FIG. 1 diagrammatically shows the burner according to the invention, applied to a pilot lighting burner.

Referring first to FIG. 1, the relatively low power burner of the invention, generally designated 1, substantially comprises a premixing chamber 2 supplied with air and combustible gas through separate intakes, respectively 3 and 4, advantageously discharging into this chamber 2 substantially radially at 13 and 14. The chamber 2 which is generally shaped like an elongated cylindrical tank of substantially circular cross-section is obstructed at its front face by a metal stabilizing grille 5 to which the flames can become attached. This grille which is relatively sensitive to thermal stresses (compared with ceramic plates) can, in a manner known per se, comprise orifices of appropriate diameter and distribution to ensure satisfactory attachment and stabilization of flames at the entrance to the combustion chamber 6 of the burner.

The inlets 3 and 4 of air and combustible gas discharge into the chamber 2 near the end opposite the grille 5.

In the case illustrated, where the burner according to the invention is used as a pilot lighting burner of a burner submersible in a liquid to be heated (designated 7 with a level 7') in a more highly powered installation, the combustion chamber 6 constitutes the combustion chamber of the main burner 10.

On its rear face, the premixing chamber 2 is closed by a wall 8 on which there is mounted in a fluid-tight manner, in order to resist the pressure inside the premixing chamber, a means 9 of visually monitoring the flame. This monitoring means may consist of a sheet of glass.

It will be seen in FIG. 1 that in designating the "front" and "rear" ends of the burner, reference is made to the circulation of air and combustible gas, then of the gaseous mixture in the burner as indicated is diagrammatically by the arrows.

As illustrated, lighting of the burner is performed by an electrode 11 supplied with appropriate high voltage as by a cable shown diagrammatically at 12 and suitably insulated, lighting being effected by sparks or by an electric arc between the tip 13' of the lighting electrode and the adjacent wall of the grille 5 which is suitably grounded via the tank which forrms the premixing chamber 2.

The cable 12 for supplying electric power to the electrode 11 passes through the wall of the chamber in question at 15, in pressure-tight fashion. Sealing-tightness may in particular be guaranteed by using a compression gland.

To ensure suitable and necessary regulation of the rates of flow of air and combustible gas over the entire range of supply pressures, there is provided at the air intake 3 a passage 16 of relatively small cross-section in relation to that of the pipe 3, this orifice being provided in a piece 17 of the diaphragm type, while on the combustible gas inlet 4 there is a device 18 with a calibrated orifice 19, of the injector or similar type.

As illustrated, the injector 18 is disposed at the level of the aperture 14 in the inlet 4, discharging into the premixing chamber 2.

In this way, a slight over-pressure is created within chamber 2 into which the mixture will flow towards the combustion chamber 6, where the pressure is slightly lower. It is possible then to easily adapt the rate of flow of air and of combustible gas required by referring to the pressure sensors 20, 21 to ascertain the static pressures existing respectively in the air supply pipe 3 and in the premixing chamber.

Figure 2:
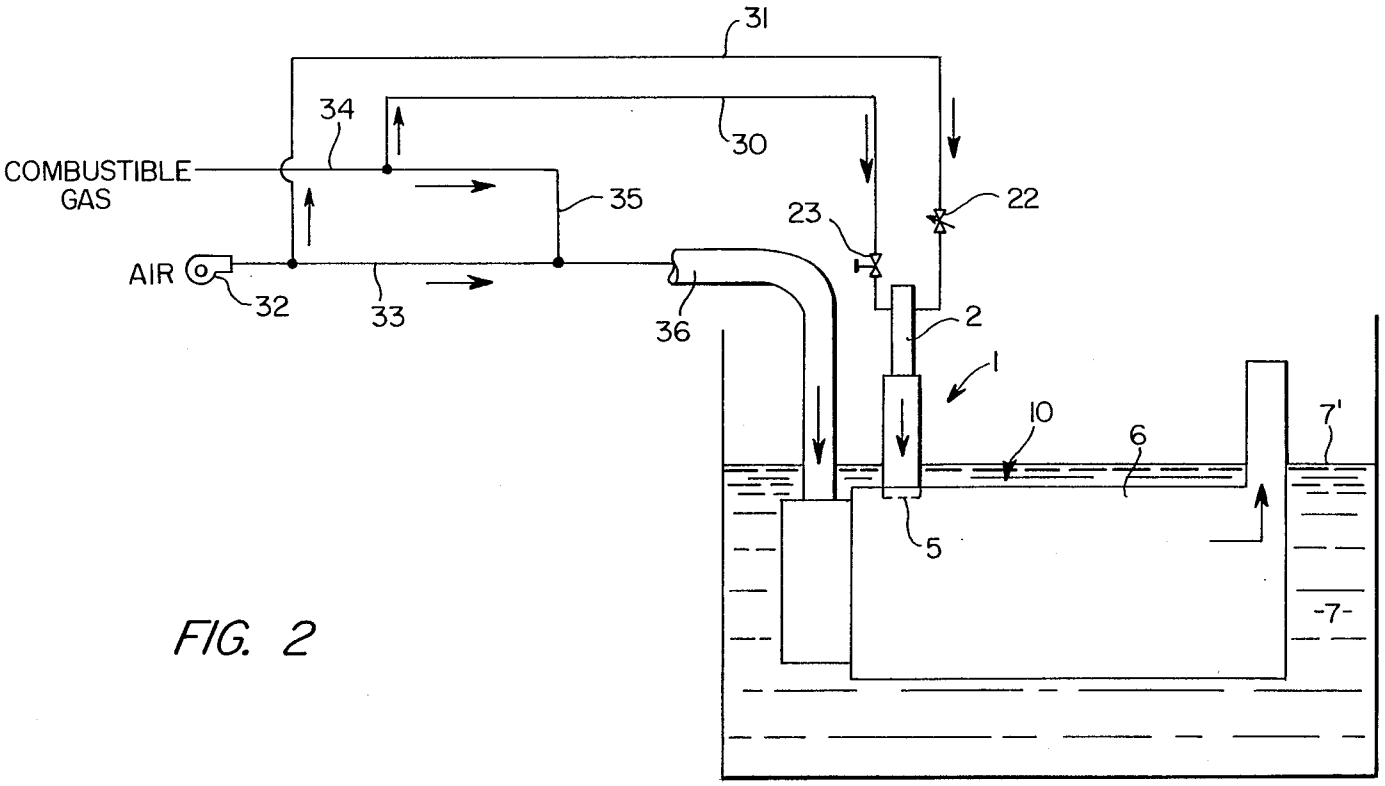
FIG. 2 shows on a smaller scale a diagram of the assembly of the burner used as a pilot burner for lighting a more highly powered submersible burner.

Regulating the flow of air to permit appropriate metering of the air/gas mixture is, on the basis of the information provided by the sensors 20, 21, carried out by means of the valve 22 provided on the inlet pipe 3 upstream of the diaphragm 17 (FIG. 2).

The rate of flow of gas is automatically regulated to the level required by the calibrated injector, whatever fluctuations in pressure of gas supply may prevail (within a current range).

As illustrated in FIG. 1, the lighting pilot burner 1 is connected to the more highly powered burner 10 via a tube 24 which is immersed in the bath 7 to be heated and which has a slightly larger diameter than that of the chamber 2. This tube 24 may consist of a substantially vertical extension projecting from the wall of the combustion chamber 6. A joint or bearing face 25 situated above the level 7' of the bath 7 makes it possible to correctly position the pilot lighting burner in relation to the main burner 6, so that the pilot discharges into the combustion chamber 6 substantially at a right-angle to the main burner, extending only very slightly into the combustion chamber in order not to upset the operating conditions of the main burner. Seals 26 can ensure sealing-tightness between the base of the tube 24 and the facing part of the premixing chamber of the pilot.

As will be appreciated, with such an arrangement and thanks to the overpressure existing in the premixing chamber 2 of the pilot burner, the depth of submersion of the main burner 10 is for practical purposes unlimited at present.

It will be generally observed in FIG. 1 that the dotted lines represent an ionizing electrode 27 passing through the flame stabilizing grille 5, in the same way as the lighting electrode 11 alongside which it is located.

Although not indispensable, such an ionizing electrode 27, when it is provided, is advantageously mounted with the lighting electrode 11, towards the central part of the flame stabilizing grille 5, substantially parallel with the direction of flow of combustible mixture from the pre mixing chamber 2 to the combustion chamber 6.

Likewise shown in dotted lines and at 28 is the cable which supplies an appropriate voltage to the suitably insulated electrode 27, the said cable 28 extending into the premixing chamber 2 before passing through the wall thereof at 29 in such a way as to be capable of withstanding the pressure in question, the grille acting as a ground for operation of the ionizing electrode.

It will be noted that the provision of such an ionizing electrode makes it possible to avoid the need to mount on the submerged main burner a flame monitoring cell of the type which is sensitive to ultra-violet rays.

Reference will now be made to FIG. 2 which shows on a smaller scale a complete diagram of the assembly of the low powered burner according to the invention in the event of its being used as a pilot lighting burner of a burner which is submersible in the liquid to be heated in a more highly powered installation.

As illustrated, the pilot burner 1 is supplied with combustible gas through a pipe 30 connected to the general distributor duct 34, and is supplied with air through a pipe 31, the air and combustible gas intakes 3 and 4 in FIG. 1 constituting the discharging ends of the pipes 30 and 31 at the level of the burner premixing chamber.

Valves 23 and 22 are shown on the pipes 30 and 31.

The pipe 31 conveying air to the pilot is in fact a pipe carrying air from the air supply pipe to the main burner.

The "total" air needed to ensure satisfactory conditions of operation at the pilot burner 1 and at the main burner 10 submerged in the bath to be heated, 7, is delivered by a fan or a compressor 32 which supplies not only the pipe 31 but also the pipe 33.

The main burner 10 is supplied with air by this pipe 33 and with combustible gas by a pipe 35 which is likewise connected to the general distribution pipe 34, the premixture then being delivered to the pipe 36 which supplies the burner 10.

In a known manner, lighting of the main burner 10 is effected by means of the pilot burner 1.

However, according to the invention, when this lighting occurs, the pilot burner 1 is supplied with a ratio of air:combustible gas which is less than the stoichiometric feed ratio. On the other hand, the main burner 10 is supplied with premixture containing a slight excess of air. Thus, the air:combustible gas fed to the pilot burner can be made up by an additional supply of air at the level of the surface of the grille as shown diagrammaticall8y at 5, discharging into the combustion chamber 6, thus providing for a stoichiometric metering out of combustible mixture from the pilot burner 1.

The excess of air present in the premixture feeding the main burner 10 and which is used by the pilot burner 1 makes it possible to restore substantially stoichiometric conditions at the level of the main burner 10.

We claim:

1. A method of lighting a pilot burner for a main burner, said pilot having a premixing chamber with separate inlets for air and combustible gas, and a metallic flame-stabilizing grille through which a mixture of air and combustible gas is introduced into a combustion chamber of said main burner, said method comprising:

feeding air and combustible gas through said inlets into said premixing chamber at a ratio of air:combustible gas less than the stoichiometric ratio thereof and passing the resulting sub-stoichiometric mixture through said grille into said combustion chamber;

feeding a mixture of air and combustible gas directly into said combustion chamber of said main burner of a ratio of air:combustible gas sufficiently greater than the stoichiometric ratio thereof to provide a stoichiometric mixture of the gases fed directly into said combustion chamber and of the gases fed through said flame-stabilizing grille, and directing toward said grille at least a portion of the mixture of gases which were directly fed into said combustion chamber; and igniting the mixture of air and combustible gas which passes through said grille from said premixing chamber.

* * * * *

UNITED STATES PATENT AND TRADEMARK OFFICE

CERTIFICATE OF CORRECTION

PATENT NO. : 4,875,850

DATED : October 24, 1989

INVENTOR(S) : Francois Cagnon, et al.

It is certified that error appears in the above-identified patent and that said Letters Patent is hereby corrected as shown below:

Column 1, line 8, change "air introducing" to --introducing air--.

Column 2, line 67, change "indicated is" to --is indicated--.

Column 3, line 3, change "as by a cable" to --by a cable as--;

line 7, change "forrms" to --forms--.

Column 4, line 54, change "diagrammatical18y" to --diagrammatically--;

line 64, after "pilot" insert --burner--.

Signed and Sealed this

Thirteenth Day of November, 1990

*Attest:*

HARRY F. MANBECK, JR.

*Attesting Officer*

*Commissioner of Patents and Trademarks*